US008800094B1

(12) United States Patent
Robinson

(10) Patent No.: US 8,800,094 B1
(45) Date of Patent: Aug. 12, 2014

(54) CLEANING CLOTH INCLUDING SEQUENTIAL INDICATORS AND DISPOSITION INDICATORS

(75) Inventor: Robert S. Robinson, Hamilton, OH (US)

(73) Assignee: Kaivac, Inc., Hamilton, OH (US)

( * ) Notice: Subject to any disclaimer, the term of this patent is extended or adjusted under 35 U.S.C. 154(b) by 568 days.

(21) Appl. No.: 12/456,691

(22) Filed: Jun. 19, 2009

Related U.S. Application Data

(60) Provisional application No. 61/132,526, filed on Jun. 19, 2008.

(51) Int. Cl.
*A47L 13/16* (2006.01)
*A47L 25/00* (2006.01)

(52) U.S. Cl.
USPC ..... 15/209.1; 15/104.93; 15/118; 15/208

(58) Field of Classification Search
USPC ..... 15/104.93, 118, 208, 209.1
See application file for complete search history.

(56) References Cited

U.S. PATENT DOCUMENTS

| | | | | | |
|---|---|---|---|---|---|
| 1,635,350 | A | * | 7/1927 | Simons | 451/527 |
| D97,464 | S | * | 11/1935 | Cohen | D5/30 |
| 2,233,746 | A | * | 3/1941 | Potter | 15/209.1 |
| D355,096 | S | | 2/1995 | Lang | |
| 5,761,761 | A | | 6/1998 | An | |
| 5,918,341 | A | * | 7/1999 | Hale | 15/209.1 |
| 6,794,352 | B2 | | 9/2004 | Svendsen | |
| 2005/0241093 | A1 | | 11/2005 | McKenzie | |
| 2008/0250681 | A1 | | 10/2008 | Jackson | |

FOREIGN PATENT DOCUMENTS

WO WO 03/092464 A1 11/2003

* cited by examiner

*Primary Examiner* — Randall Chin
(74) *Attorney, Agent, or Firm* — David E. Pritchard

(57) ABSTRACT

A cleaning cloth of the invention includes: a first face including a first fold location and a second fold location that intersects and is generally perpendicular to the first fold location, the first and second fold locations dividing the entire first face into four quadrant cleaning areas of substantially equal size, each of the first and second fold locations having a length; and a set of four sequential indicators at the first face, with one of each of the set of four sequential indicators located at one of each of the four quadrant cleaning areas. The first face is free of marked lines that extend along the entire length of each of the first and second fold locations. In this fashion, a user may fold and unfold the cleaning cloth so as to expose and use one or more of the four quadrant cleaning areas in a particular sequence by reference to the sequential indicators, and whereby a user may know which of the four quadrant cleaning areas have been used by reference to the sequential indicators. In another aspect, a cleaning cloth of the invention includes: a first face; an oppositely disposed second face; and a disposition indicator tag connected to the cleaning cloth. The tag includes a plurality of tabs with each tab having an appearance visibly distinguishable from the other tab or tabs.

14 Claims, 6 Drawing Sheets

CLEANING CLOTH INCLUDING SEQUENTIAL INDICATORS AND DISPOSITION INDICATORS

CROSS-REFERENCE TO RELATED APPLICATION

This patent document claims the benefit of the filing date of Provisional Application No. 61/132,526, entitled "Cleaning Cloth Including Sequential Indicators or Disposition Indicators" and filed on Jun. 19, 2008. The entire disclosure of Provisional Application No. 61/132,526 is incorporated into this patent document by reference.

FIELD OF THE INVENTION

This invention relates to cleaning cloths or cleaning towels.

BACKGROUND OF THE INVENTION

Cleaning cloths or towels are notorious for accumulating and spreading soils and bacteria. Typically, a user wads the cloth, and wipes down various surfaces with the wadded cloth—a practice that not only reduces the useful cleaning life of the cloth between launderings, but also results in significant cross-contamination from one surface to another.

One tentative solution to these problems has been proposed in Hale U.S. Pat. No. 5,918,341 entitled "Hand-Sized, Controlled-Fold, Cleaning Sleeve." The Hale patent discloses a sleeve in which a number of visible lines are imprinted on the sleeve material, with the lines extending across the full width of the material. The lines divide the material into a number of discrete panel sections.

Although the Hale patent proposes a tentative solution, there remains a need for a different solution to these problems.

SUMMARY OF THE INVENTION

The present invention solves the problems described above by providing a cleaning cloth that includes: a first face including a first fold location and a second fold location that intersects and is generally perpendicular to the first fold location, the first and second fold locations dividing the entire first face into four quadrant cleaning areas of substantially equal size, each of the first and second fold locations having a length; and a set of four sequential indicators at the first face, with one of each of the set of four sequential indicators located at one of each of the four quadrant cleaning areas. The first face is free of marked lines that extend along the entire length of each of the first and second fold locations. In this fashion, a user may fold and unfold the cleaning cloth so as to expose and use one or more of the four quadrant cleaning areas in a particular sequence by reference to the sequential indicators, and whereby a user may know which of the four quadrant cleaning areas have been used by reference to the sequential indicators.

In another aspect, the cleaning cloth of the present invention includes: a first face; an oppositely disposed second face; and a disposition indicator tag connected to the cleaning cloth. The tag includes a plurality of tabs with each tab having an appearance visibly distinguishable from the other tab or tabs. Each tab is separable from the tag independently of the other tab or tabs. And the presence or absence of one or more of the tabs has a predetermined meaning that is understood by a user and that correlates to an intended disposition of the cleaning cloth.

BRIEF DESCRIPTION OF THE DRAWINGS

The accompanying drawings, which are incorporated into this patent document and constitute a part of this specification, illustrate embodiments of the invention and, together with the general description of the invention given above, and the detailed description of the drawings given below, serve to explain the principles of the invention.

DETAILED DESCRIPTION OF THE DRAWINGS

Figure 1B:
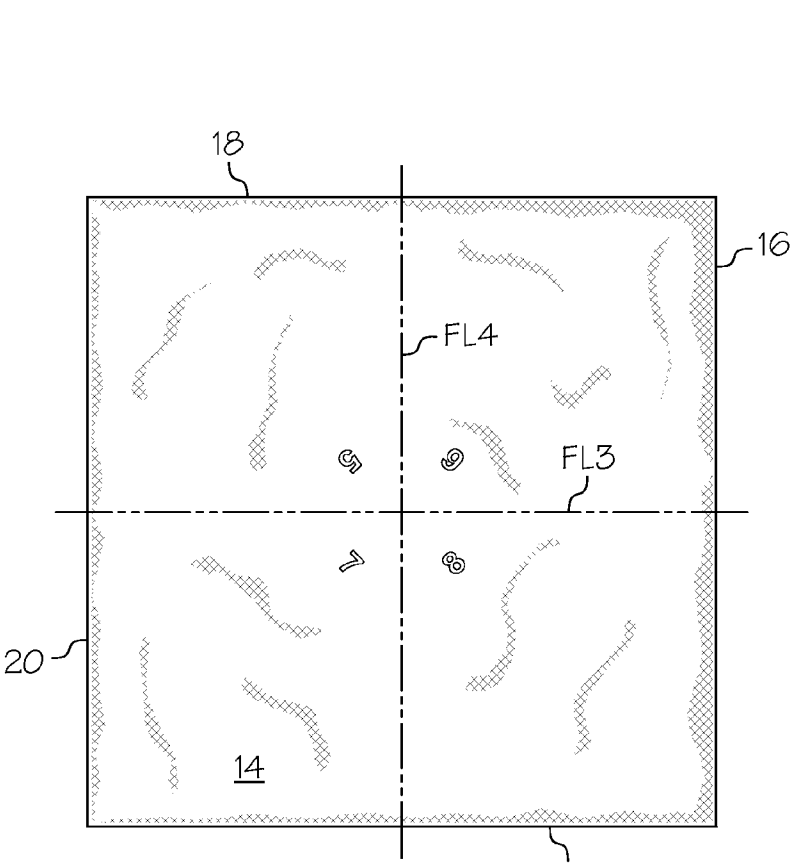
FIGS. 1A and 1B show a first embodiment of a cleaning cloth in accordance with the principles of the invention.
Figure 1A:
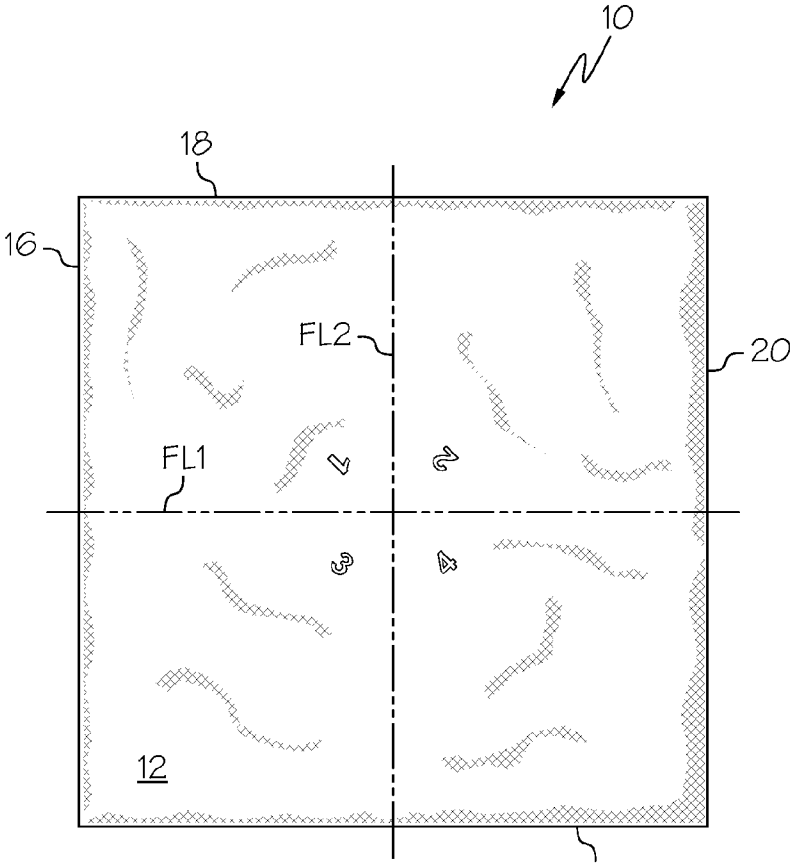

With reference to FIGS. 1A and 1B, a cleaning cloth 10 in accordance with the principles of the invention includes a first face 12 (FIG. 1A) and an oppositely disposed second face 14 (FIG. 1B). The cleaning cloth is square, having four sides 16, 18, 20, 22 of equal length.

The first face 12 includes a first fold location identified by a first unmarked line (FL1), and a second fold location that intersects and is perpendicular to the first fold location. The second fold location is identified by a second unmarked line (FL2). The first fold location extends across the first face, from side 16 to side 20; and the second fold location extends across the first face, from side 18 to side 22. The first and second fold locations divide the entire first face into four quadrant cleaning areas of equal size. Each of the four quadrant cleaning areas has a unique sequential indicator in the form of a number. As shown, the sequential indicator numbers are "1," "2," "3," and "4." The sequential indicator numbers are located near the intersection of the first and second fold locations, with each number oriented on an unmarked ray that extends from the intersection out to an adjacent corner of the cleaning cloth.

The second face 14 includes a first fold location identified by a first unmarked line (FL3), and a second fold location that intersects and is perpendicular to the first fold location. The second fold location is identified by a second unmarked line (FL4). The first fold location extends across the second face, from side 16 to side 20; and the second fold location extends across the second face, from side 18 to side 22. The first and second fold locations divide the entire second face into four quadrant cleaning areas of equal size. The first fold location (FL3) of the second face is aligned with the first fold location (FL1) of the first face; and the second fold location (FL4) of the second face is aligned with the second fold location (FL2) of the first face. Each of the four quadrant cleaning areas of the second face has a unique sequential indicator in the form of a number. As shown, the sequential indicator numbers are "5," "6," "7," and "8." The sequential indicator numbers are located near the intersection of the first and second fold locations, with each number oriented on an unmarked ray that extends from the intersection out to an adjacent corner of the cleaning cloth.

Referring to FIG. 1A, each of the first and second fold locations (identified by unmarked lines FL1 and FL2) is free of a fold location indicator. However, the first face has fold location indicators that lie outside of the fold locations themselves. Specifically, the sequential indicator numbers are both sequential indicators and fold location indicators. The number pair "1" and "2" and the number pair "3" and "4" indicate a first fold location (FL1) positioned equidistantly between the number pairs, with "1" and "2" being on one side of the first fold location, and "3" and "4" being on the other side of the first fold location. Similarly, the number pair "1" and "3" and the number pair "2" and "4" indicate a second fold location (FL2) positioned equidistantly between these number pairs, with "1" and "3" being on one side of the second fold location, and "2" and "4" being on the other side of the second fold location.

As seen in FIG. 1B, the second face has similar fold location indicators that lie outside of the first and second fold locations (FL3, FL4)—namely, sequential indicators "5" through "8." The number pair "5" and "6" and the number pair "7" and "8" indicate a first fold location (FL3) positioned equidistantly between the number pairs, with "5" and "6" being on one side of the first fold location, and "7" and "8" being on the other side of the first fold location. Similarly, the number pair "5" and "7" and the number pair "6" and "8" indicate a second fold location (FL4) positioned equidistantly between these number pairs, with "5" and "7" being on one side of the second fold location, and "6" and "8" being on the other side of the second fold location.

In use, a worker may fold the cleaning cloth in half along the first fold location (FL1) of the first face, and then fold the cloth into quarters by folding the halved cloth along the second fold location (FL2) of the first face. In folding the cloth into quarters, the worker typically makes the fold so that the quadrant cleaning areas with the sequential indicators "3" and "4" are facing one another, and the quadrant cleaning areas with the sequential indicators "1" and "2" are facing outward. The worker may clean with one of the exposed (i.e., outwardly facing) quadrant cleaning areas until it is used, and then use other cleaning areas in a particular sequence by reference to the sequential indicators, and by flipping, unfolding, and folding the cleaning cloth to expose and use the desired, fresh cleaning area(s). In this fashion, the potential for cross-contamination from one to-be-cleaned surface to another to-be-cleaned surface may be reduced or even eliminated.

If desired, once the cleaning cloth has been folded into quarters with the sequential indicators "1" and "2" facing outward, the worker may start out with indicator "1" facing toward the worker, and the cleaning area bearing indicator "2" in contact with the surface to be cleaned. Once the indicator "2" cleaning area has been used, the worker may turn the folded cloth over so that indicator "2" now faces outward, and the indicator "1" cleaning area now is used for cleaning. The worker then may invert the folded cloth so that the used indicator "1" and "2" cleaning areas face one another, while the unused indicator "3" and "4" cleaning areas face outward. The worker may continue, with the indicator "3" cleaning area facing outward, while using the indicator "4" cleaning area to clean a surface. Once the indicator "4" cleaning area has been used, the worker may turn the folded cloth over so that indicator "4" now faces outward, and the indicator "3" cleaning area now is used for cleaning. In this fashion, because the desired indicator faces outward or upward toward the worker, the worker easily can see the indicator. The worker does not have to lift the folded cleaning cloth from a work surface, and turn the folded cloth over in order to figure out which sequential indicator surface currently is being used. The worker simply follows the sequential indicator sequence of the numbers facing outward toward the worker (e.g., 1, 2, 3, and 4). This same concept may be employed in using the four cleaning areas (with sequence indicators 5-8) of the second face.

The cleaning cloth embodiments illustrated in FIGS. 2-4 include several of the features and aspects of the embodiment shown in FIG. 1 and described in detail above. Accordingly, those similar features and aspects are not described in detail below. Instead, the description of the embodiments shown in FIGS. 2-4 focuses on the aspects and features of these particular embodiments that are different from those of the FIG. 1 embodiment. Where appropriate, like reference numbers and reference characters are used across various embodiments to identify features that are the same or substantially similar.

Figure 2B:
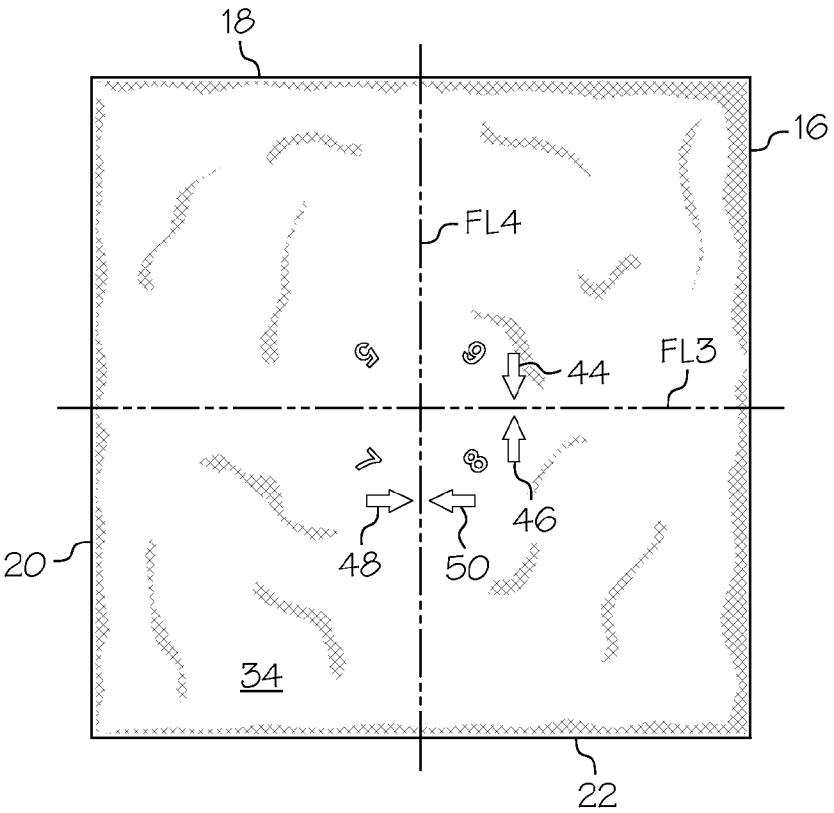
FIGS. 2A and 2B show a second embodiment of a cleaning cloth of the invention.
Figure 2A:
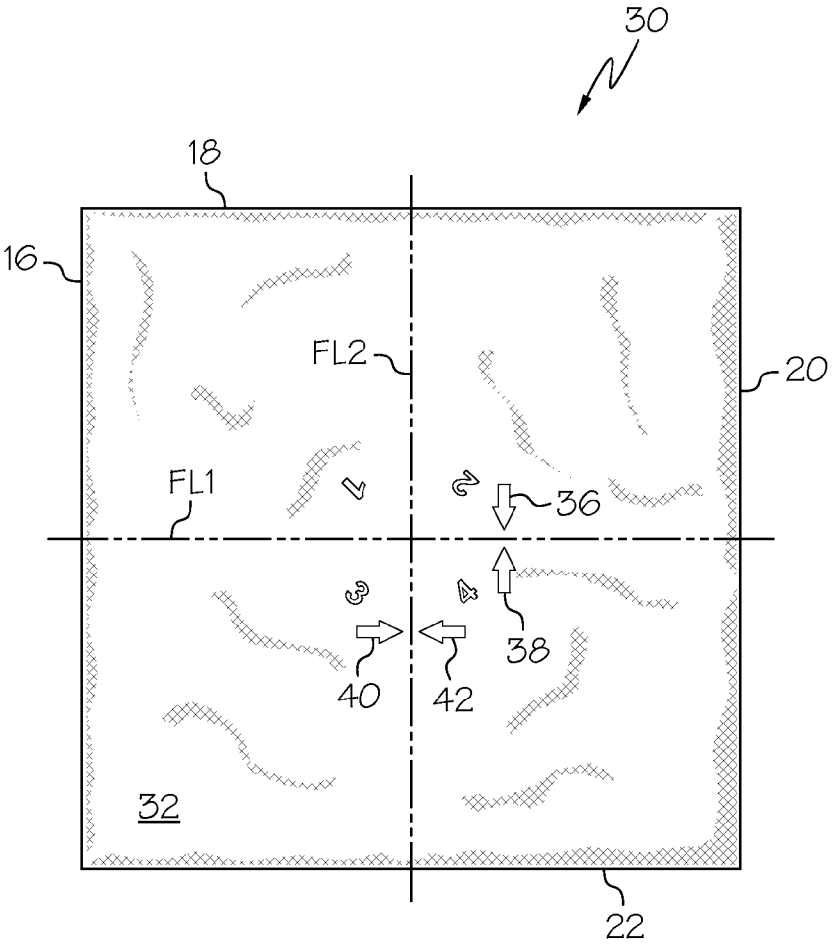

With reference to FIGS. 2A and 2B, a cleaning cloth 30 includes a first face 32 (FIG. 2A) and an oppositely disposed second face 34 (FIG. 2B). The cleaning cloth is square, having four sides 16, 18, 20, 22 of equal length.

The first face 32 includes a first fold location identified by a first unmarked line (FL1), and a second fold location that intersects and is perpendicular to the first fold location. The second fold location is identified by a second unmarked line (FL2). The first fold location extends across the first face, from side 16 to side 20; and the second fold location extends across the first face, from side 18 to side 22. The first and second fold locations divide the entire first face into four quadrant cleaning areas of equal size. Each of the four quadrant cleaning areas has a unique sequential indicator in the form of a number. As shown, the sequential indicator numbers are "1," "2," "3," and "4." The sequential indicator numbers are located near the intersection of the first and second fold locations, with each number oriented on an unmarked ray that extends from the intersection out to an adjacent corner of the cleaning cloth.

The second face 34 includes a first fold location identified by a first unmarked line (FL3), and a second fold location that intersects and is perpendicular to the first fold location. The second fold location is identified by a second unmarked line (FL4). The first fold location extends across the second face, from side 16 to side 20; and the second fold location extends across the second face, from side 18 to side 22. The first and second fold locations divide the entire second face into four quadrant cleaning areas of equal size. The first fold location (FL3) of the second face is aligned with the first fold location (FL1) of the first face; and the second fold location (FL4) of the second face is aligned with the second fold location (FL2) of the first face. Each of the four quadrant cleaning areas of the second face has a unique sequential indicator in the form of a number. As shown, the sequential indicator numbers are "5," "6," "7," and "8." The sequential indicator numbers are located near the intersection of the first and second fold locations, with each number oriented on an unmarked ray that extends from the intersection out to an adjacent corner of the cleaning cloth.

Each of the first and second fold locations (of both the first and second faces) is free of a fold location indicator. However, the first and second faces have fold location indicators that lie outside of the fold locations themselves. Specifically, the sequential indicator numbers are both sequential indicators and fold location indicators, as described in detail above in connection with the cleaning cloth of FIGS. 1A and 1B. Also, each face of the cleaning cloth has additional fold location indicators in the form of arrows.

With reference to FIG. 2A, each of arrows 36, 38 is a fold location indicator for the first fold location (FL1); and each of arrows 40, 42 is a fold location indicator for the second fold location (FL2). Referring to FIG. 2B, each of arrows 44, 46 is a fold location indicator for the first fold location (FL3); and each of arrows 48, 50 is a fold location indicator for the second fold location (FL4).

Figure 3B:
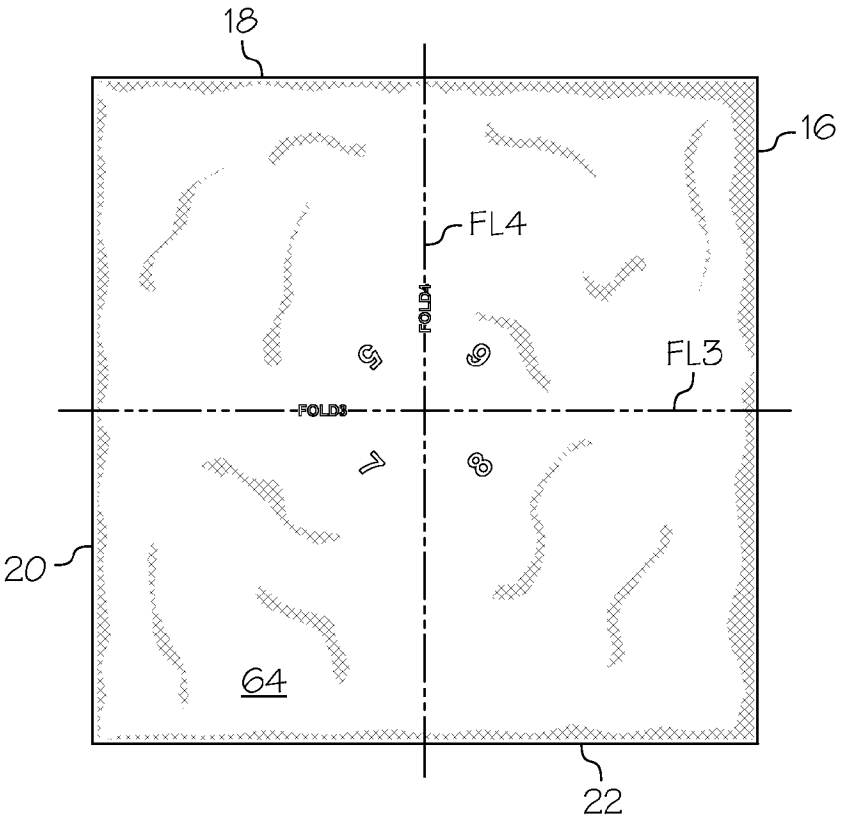
FIGS. 3A and 3B show a third embodiment of a cleaning cloth of the invention.
Figure 3A:
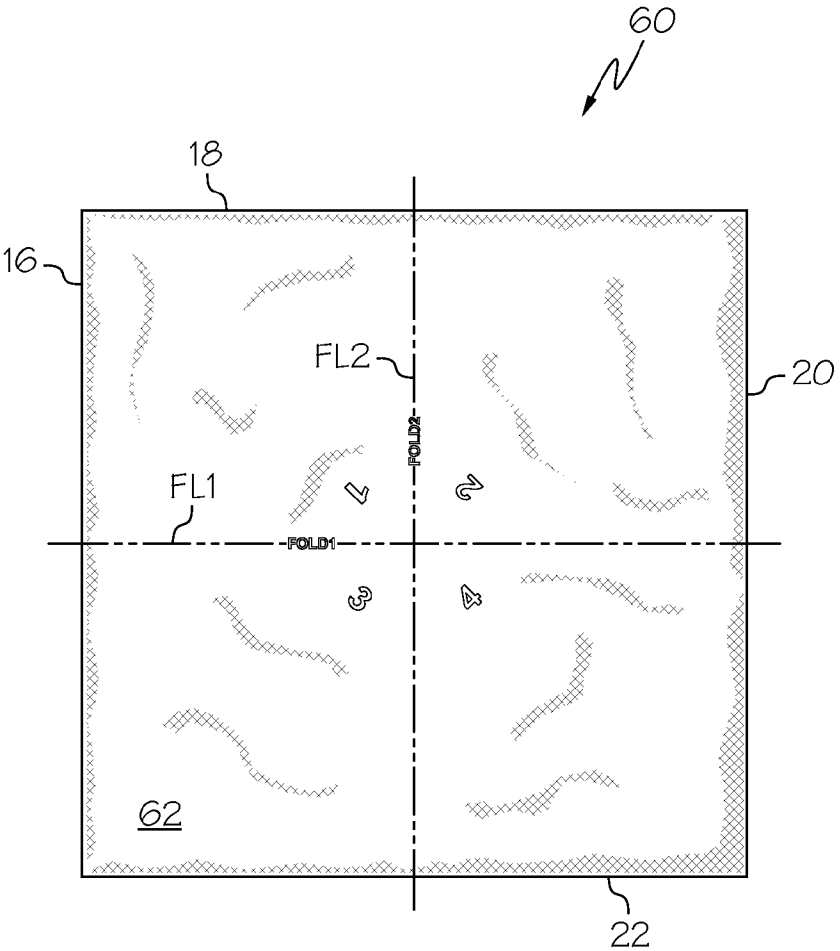

With reference to FIGS. 3A and 3B, a cleaning cloth 60 includes a first face 62 (FIG. 3A) and an oppositely disposed second face 64 (FIG. 3B). The cleaning cloth is square, having four sides 16, 18, 20, 22 of equal length.

The first face 62 includes a first fold location identified by a first unmarked line (FL1), and a second fold location that intersects and is perpendicular to the first fold location. The second fold location is identified by a second unmarked line (FL2). The first fold location extends across the first face, from side 16 to side 20; and the second fold location extends across the first face, from side 18 to side 22. The first and second fold locations divide the entire first face into four quadrant cleaning areas of equal size. Each of the four quadrant cleaning areas has a unique sequential indicator in the form of a number. As shown, the sequential indicator numbers are "1," "2," "3," and "4." The sequential indicator numbers are located near the intersection of the first and second fold locations, with each number oriented on an unmarked ray that extends from the intersection out to an adjacent corner of the cleaning cloth.

The second face 64 includes a first fold location identified by a first unmarked line (FL3), and a second fold location that intersects and is perpendicular to the first fold location. The second fold location is identified by a second unmarked line (FL4). The first fold location extends across the second face, from side 16 to side 20; and the second fold location extends across the second face, from side 18 to side 22. The first and second fold locations divide the entire second face into four quadrant cleaning areas of equal size. The first fold location (FL3) of the second face is aligned with the first fold location (FL1) of the first face; and the second fold location (FL4) of the second face is aligned with the second fold location (FL2) of the first face. Each of the four quadrant cleaning areas of the second face has a unique sequential indicator in the form of a number. As shown, the sequential indicator numbers are "5," "6," "7," and "8." The sequential indicator numbers are located near the intersection of the first and second fold locations, with each number oriented on an unmarked ray that extends from the intersection out to an adjacent corner of the cleaning cloth.

The sequential indicator numbers are both sequential indicators and fold location indicators, as described in detail above in connection with the cleaning cloth of FIGS. 1A and 1B. Also, each face of the cleaning cloth has additional fold location indicators in the form of a "Fold" phrase on each of the fold locations. As seen in FIG. 3A, the phrase "Fold 1" is positioned on the first fold location (FL1); and the phrase "Fold 2" is positioned on the second fold location (FL2). As seen in FIG. 3B, the phrase "Fold 3" is positioned on the first fold location (FL3); and the phrase "Fold 4" is positioned on the second fold location (FL4).

Figure 4B:
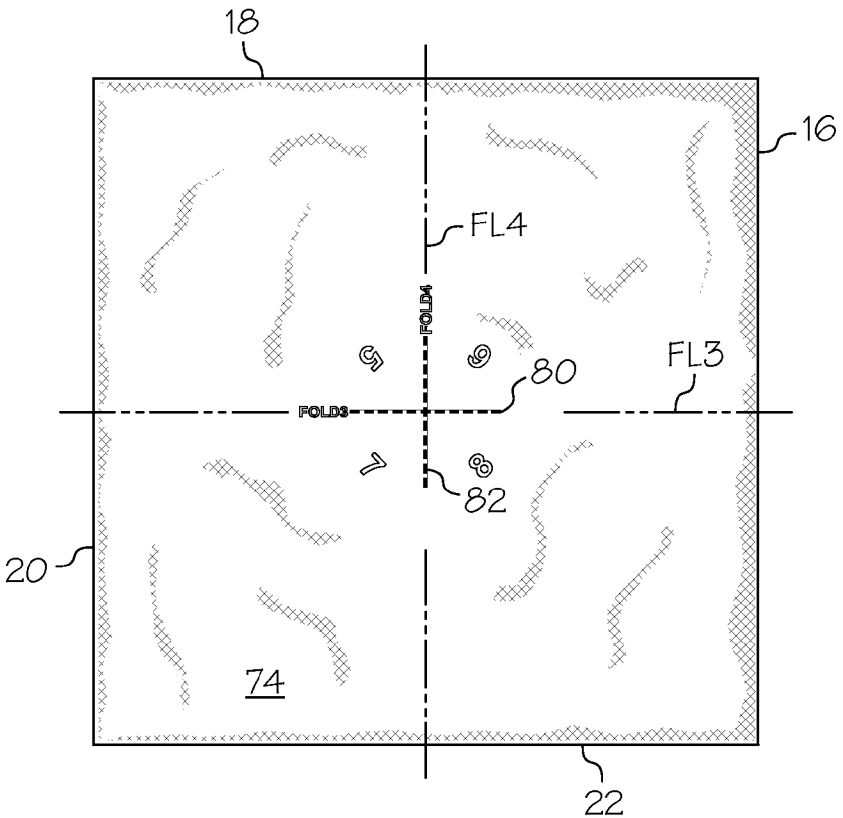
FIGS. 4A and 4B show a fourth embodiment of a cleaning cloth of the invention.
Figure 4A:
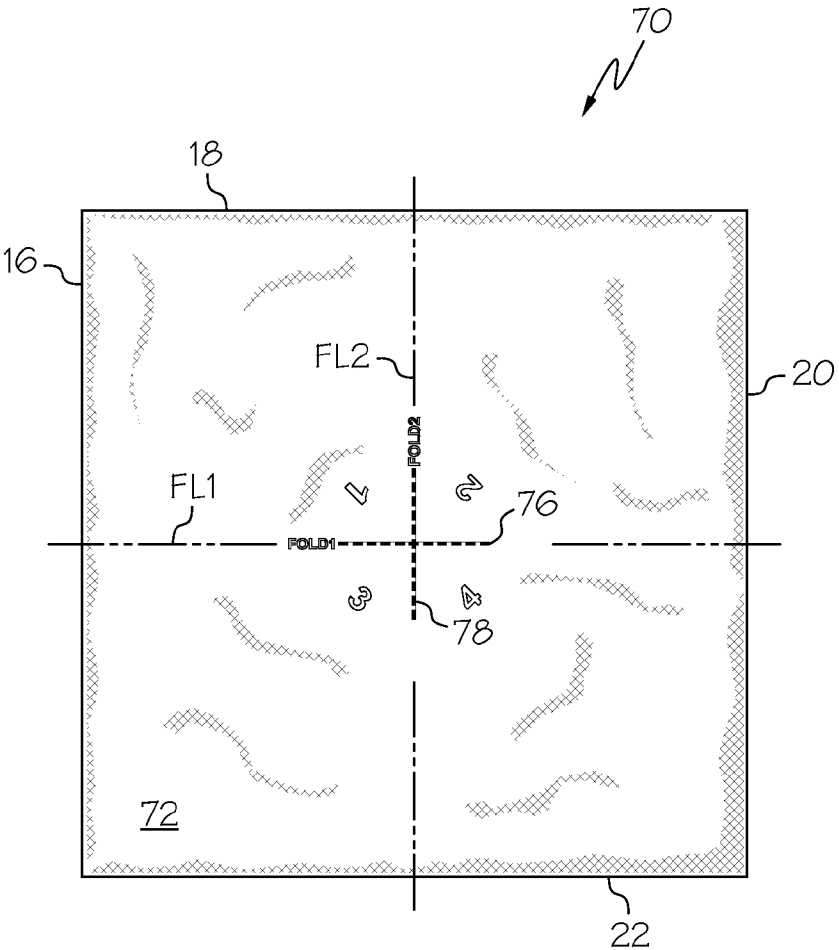

With reference to FIGS. 4A and 4B, a cleaning cloth 70 includes a first face 72 (FIG. 4A) and an oppositely disposed second face 74 (FIG. 4B). The cleaning cloth is square, having four sides 16, 18, 20, 22 of equal length.

The first face 72 includes a first fold location identified by a first unmarked line (FL1), and a second fold location that intersects and is perpendicular to the first fold location. The second fold location is identified by a second unmarked line (FL2). The first fold location extends across the first face, from side 16 to side 20; and the second fold location extends across the first face, from side 18 to side 22. The first and second fold locations divide the entire first face into four quadrant cleaning areas of equal size. Each of the four quadrant cleaning areas has a unique sequential indicator in the form of a number. As shown, the sequential indicator numbers are "1," "2," "3," and "4." The sequential indicator numbers are located near the intersection of the first and second fold locations, with each number oriented on an unmarked ray that extends from the intersection out to an adjacent corner of the cleaning cloth.

The second face 74 includes a first fold location identified by a first unmarked line (FL3), and a second fold location that intersects and is perpendicular to the first fold location. The second fold location is identified by a second unmarked line (FL4). The first fold location extends across the second face, from side 16 to side 20; and the second fold location extends across the second face, from side 18 to side 22. The first and second fold locations divide the entire second face into four quadrant cleaning areas of equal size. The first fold location (FL3) of the second face is aligned with the first fold location (FL1) of the first face; and the second fold location (FL4) of the second face is aligned with the second fold location (FL2) of the first face. Each of the four quadrant cleaning areas of the second face has a unique sequential indicator in the form of a number. As shown, the sequential indicator numbers are "5," "6," "7," and "8." The sequential indicator numbers are located near the intersection of the first and second fold locations, with each number oriented on an unmarked ray that extends from the intersection out to an adjacent corner of the cleaning cloth.

The sequential indicator numbers are both sequential indicators and fold location indicators, as described in detail above in connection with the cleaning cloth of FIGS. 1A and 1B. Also, each face of the cleaning cloth has additional fold location indicators in the form of a "Fold" phrase on each of the fold locations, as well as a centrally located, marked dashed line that extends partway along the length of each of the fold locations.

As seen in FIG. 4A, the phrase "Fold 1" is positioned adjacent a centrally located, marked dashed line 76 that extends partway along the length of the first fold location (FL1); and the phrase "Fold 2" is positioned adjacent a centrally located, marked dashed line 78 that extends partway along the length of the second fold location (FL2). The two marked dashed lines intersect each other. With reference to FIG. 4B, the phrase "Fold 3" is positioned adjacent a centrally located, marked dashed line 80 that extends partway along the length of the first fold location (FL3); and the phrase "Fold 4" is positioned adjacent a centrally located, marked dashed line 82 that extends partway along the length of the second fold location (FL4). Here also, the two marked dashed lines intersect each other. If desired, any of the marked dashed lines may extend about one-fourth of the length of the corresponding fold location, about one-third of the length of the corresponding fold location, or from about one-fourth to about one-third of the length of the corresponding fold location.

Figure 5:
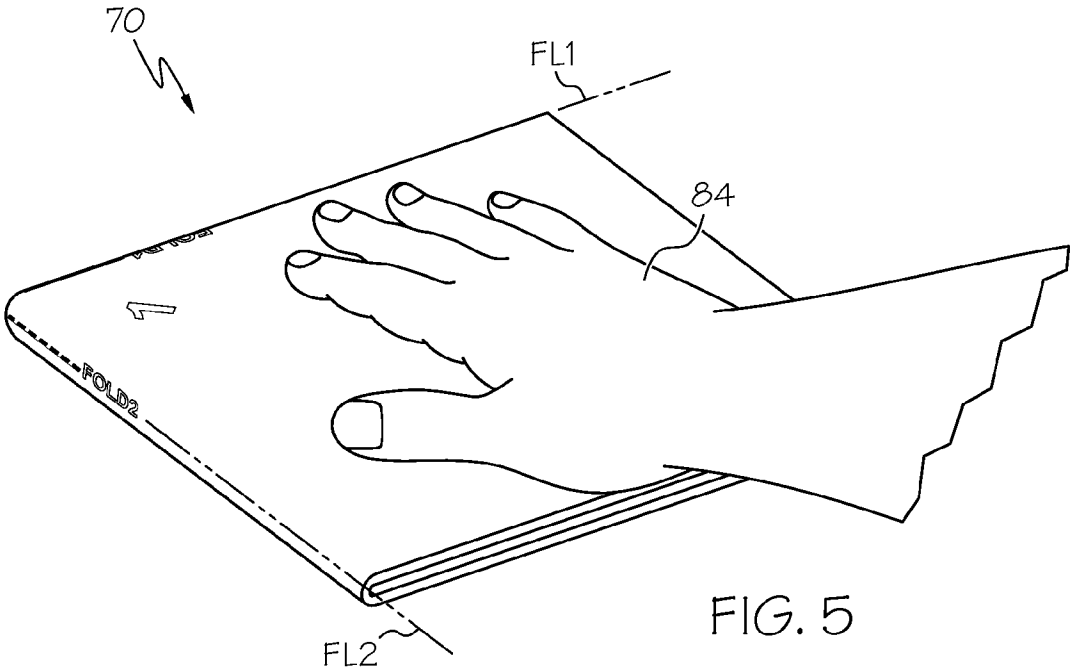
FIG. 5 shows the embodiment of FIGS. 4A and 4B in use.

With reference to FIG. 5, the cleaning cloth 70 of FIGS. 4A and 4B is shown in a folded state. The cloth has been folded at the first fold location (FL1), and then at the second fold location (FL2), and is oriented with sequential indicator "1" facing upward (e.g., toward a user). A user's hand 84 is positioned on the upwardly facing quadrant cleaning area, in a way in which the user might support the cloth against a surface being cleaned. As can be seen, the user's fingers are oriented generally toward the first fold location (FL1); and the sequential indicator "1" is prominently displayed and readily visible to the user.

Figure 6:
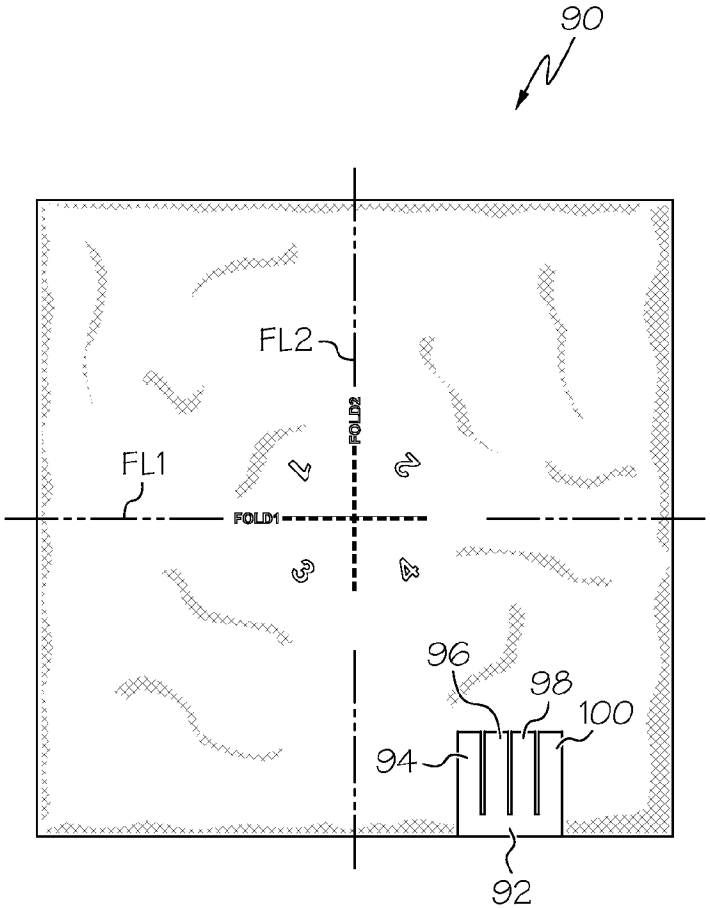
FIG. 6 shows a fifth embodiment of a cleaning cloth of the invention.

Referring to FIG. 6, the first face of a cleaning cloth 90 substantially similar to the cleaning cloth 70 of FIGS. 4A and 4B is shown. The cloth 90 includes all of the aspects of the cloth 70, and so those aspects are not repeated here. In addition, a disposition indicator tag 92 is connected to the cloth. The tag has four tabs 94, 96, 98, 100 with each tab being separable from the tag independent of the other tabs. Also, each tab has a color different from that of the other tabs. Tab 94 is red, tab 96 is yellow, tab 98 is green, and tab 100 is blue. The tabs and their colors are visible to a user. Depending, for example, on the facility to be cleaned, or on the desires of the facility management team, one or more of the colored tabs may be removed from the cloth. Typically this is done before the cloth is used for cleaning. The presence or absence of one or more of the tabs has a predetermined meaning that is understood by a user and that correlates to an intended disposition of the cleaning cloth. The intended disposition may be, for example, the use of the cloth to clean a particular type of location within a facility, the use of the cloth for a particular type of cleaning, or the use of the cloth with a particular cleaning chemical. If the tabs are used to designate use in particular locations within a facility, one such designation system may be, for example: red for restrooms; yellow for kitchens; green for offices; and blue for manufacturing areas.

A cleaning cloth in accordance with the principles of the invention may be made of any suitable material or combination of materials, and may be made using any suitable manufacturing technique(s). For example, the fabric may include natural and/or synthetic fibers. If desired, the fabric may be a microfiber fabric. If desired, the sequential indicators and other fold location indicators may be printed on the fabric. Also, if desired, the disposition indicator tag may be made of a durable synthetic material, and may be stitched to the cloth. In similar fashion, the cleaning cloth may have any suitable dimensions. For example, the cleaning cloth may be approximately 16 inches×16 inches. One exemplary cleaning cloth in accordance with the principles of the invention is the Smart Towel™ cleaning cloth commercially available from Kaivac, Inc. of Hamilton Ohio.

While the present invention has been illustrated by a description of a few embodiments, and while the illustrative embodiments have been described in considerable detail, it is not the intention of the inventor to restrict or in any way limit the scope of the following claims to such detail. Additional advantages and modifications readily will appear to those skilled in the art upon a reading of this patent document. For example, the cleaning cloth may be circular in shape. Also, the cleaning cloth may be formed of a single piece of fabric, or may be formed by joining multiple pieces of fabric together. The invention, in its broader aspects, is therefore not limited to the specific details, representative apparatus and methods, and illustrative examples shown and described in this patent document.

What is claimed is:

1. A cleaning cloth, comprising:

a first face including a first fold location and a second fold location that intersects and is generally perpendicular to the first fold location, the first and second fold locations dividing the entire first face into four quadrant cleaning areas of substantially equal size, each of the first and second fold locations having a length;

a set of four sequential indicators at the first face, with one of each of the set of four sequential indicators located at one of each of the four quadrant cleaning areas;

the first face being free of marked lines that extend along the entire length of each of the first and second fold locations, whereby a user may fold and unfold the cleaning cloth so as to expose and use one or more of the four quadrant cleaning areas in a particular sequence by reference to the sequential indicators, and whereby a user may know which of the four quadrant cleaning areas have been used by reference to the sequential indicators.

2. The cleaning cloth of claim 1 wherein each of the first set of four sequential indicators includes one or more of a letter and a number.

3. The cleaning cloth of claim 1 wherein each of the first set of four sequential indicators is proximate the intersection of the first and second fold locations, whereby when the cleaning cloth is folded along the first and second fold locations, resulting in two outwardly-facing quadrant cleaning areas, the sequential indicator on each of the two outwardly-facing quadrant cleaning areas is readily visible to a user when the user holds the cleaning cloth with the user's fingers generally oriented toward a portion of the first or second fold location.

4. The cleaning cloth of claim 1 wherein the four sequential indicators also serve as fold location indicators.

5. The cleaning cloth of claim 1 further including a fold location indicator extending partway along the length of one of the first and second fold locations.

6. The cleaning cloth of claim 5 wherein the fold location indicator includes one or more of a letter and a number.

7. The cleaning cloth of claim 5 wherein the fold location indicator includes a marked line.

8. The cleaning cloth of claim 1 wherein each of the first and second fold locations is free of a fold location indicator.

9. The cleaning cloth of claim 1 wherein the first fold location is identified by first and second fold location indicators, the first fold location indicator positioned proximate and on one side of the first fold location, and the second fold location indicator positioned proximate and on the other side of the first fold location.

10. The cleaning cloth of claim 9 wherein the first fold location indicator includes an arrow, and the second fold location indicator includes another arrow.

11. The cleaning cloth of claim 1 further comprising:

an oppositely disposed second face, the second face including a first fold location and a second fold location that intersects and is generally perpendicular to the first fold location, the first and second fold locations dividing the entire second face into four quadrant cleaning areas of substantially equal size, each of the second-face first and second fold locations having a length;

a set of four sequential indicators at the second face, with one of each of the set of four second-face sequential indicators located at one of each of the four second-face quadrant cleaning areas;

the second face being free of marked lines that extend along the entire length of each of the second-face first and second fold locations, whereby a user may fold and unfold the cleaning cloth so as to expose and use one or more of the second-face four quadrant cleaning areas in a particular sequence by reference to the second-face sequential indicators, and whereby a user may know which of the second-face four quadrant cleaning areas have been used by reference to the second-face sequential indicators.

12. The cleaning cloth of claim 1 further including a disposition indicator tag connected to the cloth, the tag including a plurality of tabs with each tab having an appearance visibly distinguishable from the other tab or tabs, each tab further being separable from the tag independently of the other tab or tabs, the presence or absence of one or more of the tabs having a predetermined meaning that is understood by a user and that correlates to an intended disposition of the cleaning cloth.

13. The cleaning cloth of claim 12 wherein the intended disposition is one or more of use of the cloth to clean a particular type of location within a facility, use of the cloth for a particular type of cleaning, and use of the cloth with a particular cleaning chemical.

14. The cleaning cloth of claim 12 wherein each tab includes a color different from that of the other tab or tabs.

* * * * *